United States Patent [19]

Kane

[11] 4,359,172

[45] Nov. 16, 1982

[54] METHOD OF STIMULATING FLOW OF PARTICULATES

[75] Inventor: John J. Kane, Millcreek Township Erie County, Pa.

[73] Assignee: The Pittsburgh & Conneaut Dock Company, Conneaut, Ohio

[21] Appl. No.: 209,597

[22] Filed: Nov. 24, 1980

[51] Int. Cl.[3] ..... B65G 3/14

[52] U.S. Cl. ..... 222/1; 222/203

[58] Field of Search ..... 222/198, 202, 203, 1, 222/196, 386.5

[56] References Cited

U.S. PATENT DOCUMENTS

| | | | |
|---|---|---|---|
| 2,646,905 | 7/1953 | Vincent | 222/203 |
| 2,931,523 | 6/1957 | Nelligan . | |
| 3,146,915 | 9/1964 | Gregor . | |
| 3,327,832 | 6/1966 | Kyle . | |
| 3,525,445 | 7/1968 | Barger | 222/196 |
| 3,537,540 | 11/1970 | Zuppiger et al. . | |
| 3,543,907 | 11/1970 | Pool et al. . | |
| 3,693,740 | 9/1972 | Lewis et al. . | |
| 3,809,341 | 5/1974 | evin et al. . | |
| 4,124,115 | 11/1978 | Moss . | |

FOREIGN PATENT DOCUMENTS

| | | | |
|---|---|---|---|
| 2062630 | 6/1972 | Fed. Rep. of Germany | 222/203 |
| 2449858 | 4/1976 | Fed. Rep. of Germany . | |
| 1336861 | 11/1973 | United Kingdom | 222/203 |

*Primary Examiner*—David A. Scherbel

*Attorney, Agent, or Firm*—William F. Reismeyer, III

[57] ABSTRACT

This invention relates to a method for stimulating flow of particulates toward an outlet of a container or other enclosure. A flexible wear-resistant liner is provided to cover an interior surface of the container along with a plurality of inflatable members at spaced locations juxtaposed between the surface and the liner. The members are inflated and deflated in any of various cyclic patterns so as to separate weakly adherent particulates from the liner and also dislodge jammed particulates in the central area of the container or enclosure, stimulating flow.

7 Claims, 5 Drawing Figures

METHOD OF STIMULATING FLOW OF PARTICULATES

BACKGROUND OF THE INVENTION

This invention relates to a method of stimulating flow of particulates in a container or other enclosure.

A problem has existed for many years in maintaining uniform flow of particulates through a container. Coal, ore, sand, cement and other materials tend to jam and become impacted in a conical zone over the container outlet as is well known. This condition is variously referred to as bridging, caking or ratholing.

To alleviate this condition several things have been tried. Vibrators for shaking the container or its walls have been used. Air has been introduced to fluidize the particulates. And finally explosive injections of air have been tried when the material becomes completely blocked and will not flow. None of these has been truly effective in the sense of preventing blockage and maintaining uniform flow.

Another problem which sometimes occurs is that the particulates tend to adhere to the walls of the container. One example of this occurs in containers for handling moist materials in cold temperature environments. Frozen particulates tend to form on the cold walls and causes the particles to stick to them. Additional particles collect on those already frozen and build up to a point where removal is essential. It is known to apply heat externally to metal walls, but this is not practical where they are of thick concrete. Heating by electric panels or other internal means results in high installation and operating costs.

I have found an alternative which is effective for eliminating adhesion due to freezing conditions which is also effective for relieving bridging or ratholing.

It is known to provide resilient material covering the wall of a container and intermittently inflating and deflating the cover to dislodge bridged or caked materials. Such is described in West German Offenlegungschriften 2,249,858. However, there is no suggestion in that published patent application that the invention there disclosed would be effective for removing ice from container walls. Moreover, no such suggestion can be inferred from the disclosure therein since it is directed to alleviating caking of soft powdery materials. Also, the configuration used in the German application shows direct contact of the resilient inflatable material with the powder and holes in the container wall itself through which air is injected to inflate or balloon out the cover. Harder more abrasive materials would quickly puncture such a cover and render it useless.

It is also known to provide a loose plastic inflatable liner in the cavity of railroad hopper cars. This is shown in U.S. Pat. No. 2,931,523 Nelligan. However, the liner there disclosed is used to provide more storage space for material since it is used in a flat bottom type car. When inflated the liner bows out in an upward facing convex air causing the particles to roll downward toward the outlet.

Finally, it is known to provide bags of non-resilient material on walls of sand hoppers and to intermittently inflate and deflate then to relieve ratholing. Again, there has been no suggestion that such could be adapted to provide the additional function of separating frozen particulates or other weakly adherent particulates from the container wall.

SUMMARY OF THE INVENTION

According to this invention a method is provided for stimulating flow of particulates toward a container outlet by (a) separating any weakly adhered particulates from the walls of the container, and (b) relieving bridging or ratholing conditions as well. The method includes providing a flexible wear-resistant liner on at least part of an interior surface of the container wall and a plurality of inflatable members at spaced locations along the surface juxtaposed the wall and the liner. The members are inflated and deflated cyclically so as to create undulations in the liner sufficient to achieve separation of particulates from it and dislodge those particulates subject to bridging, causing all to flow freely toward the outlet.

The invention may be used on many types of containers. For purposes of the claims the term is intended to cover bins, hoppers, trucks, railroad hopper cars and others in which the same problems of obtaining uniform flow of particulates exist. Since injection of fluid through a hole in the container wall is not required, the invention may be used on containers with any wall material, even concrete. The liner may be installed on either sloped or vertical walls. Usually the sloped walls on which it is used make an angle of between 0 and 45 degrees with a vertical plane. Although useful for removing frozen particulates from the walls, the invention is also applicable for separating other weakly adherent particulates, but not those glued, cemented or other strongly adherent chemically bonded materials.

The invention is directed to separation of adhered materials by provision of a liner that is loose enough on the wall surface that undulations can be created in it substantially without stretching the liner material itself so that punctures and excessive wear of the liner are prevented depending on the specific type of particulates being handled. This feature provides several advantages, the primary one being use of the invention where hard, abrasive particulates of sharp angular shape are handled. Another advantage is that the liner is easy to install since it need be attached only as necessary for retaining its position on the wall. For example, it may be attached to the wall itself, along all or part of its periphery, or otherwise supported and laying free on the wall.

The liner may be of most any type material, e.g. woven cloth or metal fabric, various elastomers, or combinations of cloth, metal or elastomer. Elastomers of Durometer Hardness greater than 60 are preferred for increased wear resistance to hard materials of angular shape. Conveyor belt used to convey such materials provides an excellent liner. Similarly, the inflatable members may be formed of any of the same materials, or others provided leakage of the inflating fluid is prevented. The members may be separate from the liner, attached to it, or formed integrally with it. To minimize wear, fabric members may have an elastomeric coating or cover, or be encased in sacks of elastomeric material attached to the liner.

The size and spacing of the members as well as the relative rigidity of the liner all have an effect on the wave motion obtained when the members are inflated. These factors may be controlled in order to achieve the objects of the invention. Preferably, the undulatory movement in the liner adjacent each of the inflatable members overlaps that of its nearest neighboring members. Thus, the entire liner surface will be subjected to movement. Combining this with cyclic inflation of alternate of the members while simultaneously deflating those interspersed therebetween will provide flexing of the liner alternately from convex to concave curvature which would be especially advantageous for removal of the more adherent of the particulates from the liner.

The inflating system may be either hydraulic or pneumatic. Each member should be provided with connections for introducing and exhausting the inflating fluid, each in turn connected to suitable manifolds. Various conventional means may be used to control the intermittent inflation and deflation of the members. Preferably, solenoid operated valves and timers are used. The pattern of undulations induced in the liner may be controlled by arrangement of the manifolds and piping in combination with that of the members. For example the members may be arranged in horizontal rows, each row containing two or more members. Inflation of all of the members in alternate rows while simultaneously deflating all the members in other of the rows, and vise versa will tend to provide a downward push on the particulates accelerating their movement toward the outlet. Inflation of all of the members in vertical columns will create vertical waves. Similarly, introducing fluid to each of the members at a portion of them located at about their highest elevation with respect to the container outlet will create a wave in each member during inflation also tending to push the particulates downward. This latter feature may be utilized to especial advantage with elongated members extending axially in a direction generally toward the container outlet.

DESCRIPTION OF THE PREFERRED EMBODIMENT

Figure 1:
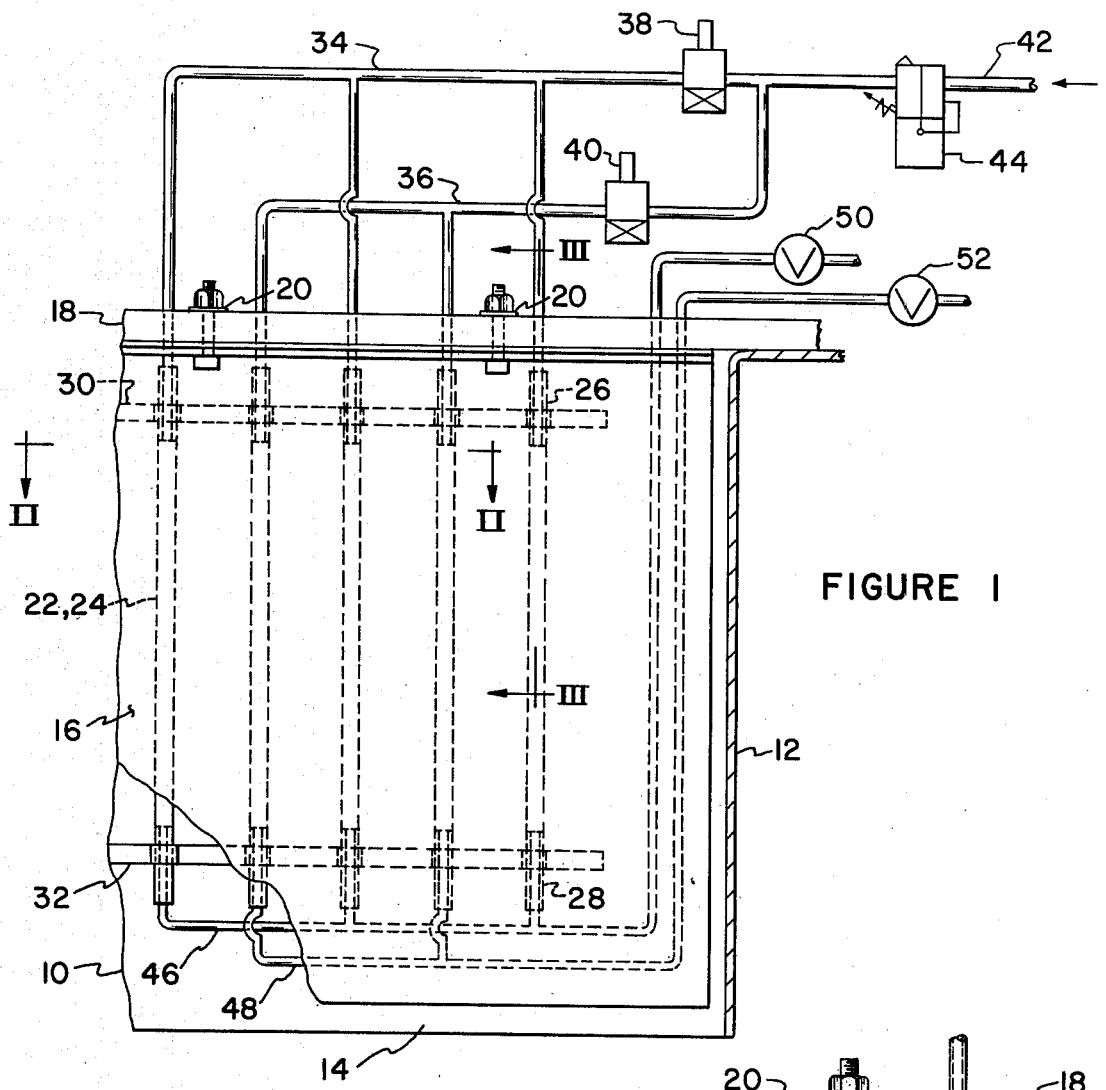
FIG. 1 is a schematic front elevation view of apparatus for carrying out the method of this invention.
Figure 2:
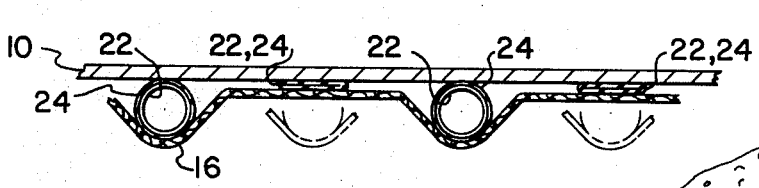
FIG. 2 is an end view taken at II—II of FIG. 1 illustrating the undulations created in the liner.
Figure 3:
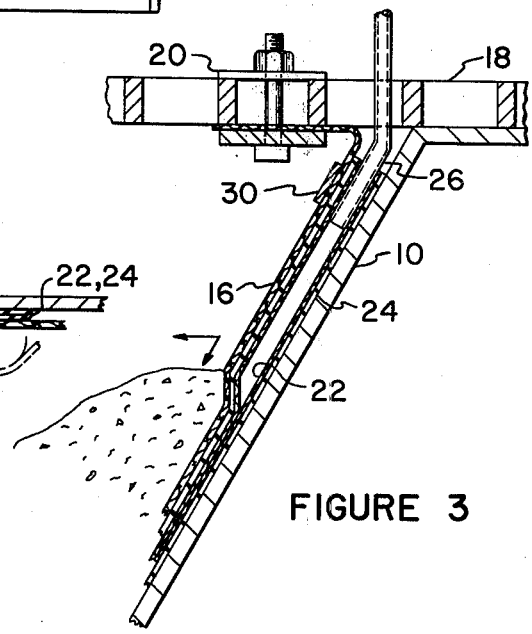
FIG. 3 is a partial side view taken at III—III of FIG. 1 illustrating the longitudinal wave created in each of the elongated members during inflation of them.

FIGS. 1, 2 and 3 illustrate a preferred arrangement for carrying out the method of this invention. FIG. 1 shows walls 10, 12 of a typical container where wall 10 slopes toward outlet 14. Liner 16 of conveyor belt material is provided as a cover for wall 10. The conveyor belt is of hard rubber and fabric construction so as to be abrasion resistant and essentially puncture proof. The particular container illustrated is a hopper having horizontal grid 18 to which the upper end of liner 16 is conveniently secured by clamp arrangement 20. The liner hangs loosely from the grid covering spaced inflatable members 22 of collapsible water hose type material. Each member is mounted in an elastomeric abrasion resistant sleeve 24 to reduce abrasion against wall 10.

Fittings 26, 28 in opposite ends of members 22 are attached to spacer bars 30, 32 mounted on wall 10 to hold the members in position. Alternate members are connected to manifold 34, the remaining ones to manifold 36. Solenoid valves 38, 40 are connected separately for alternately introducing air to the members and to the manifolds exhausting it therefrom. A high pressure air supply line 42 is connected to pressure reducer 44 which in turn provides low pressure air to the solenoid valves. The solenoids are energized in timed sequence so that alternate members are inflated while the others are simultaneously deflated. Various manual or automatic timing or switching controls can be used to establish the cycle period.

The lower end of each member is connected to manifold lines 46, 48 each normally blocked by shut off valves 50, 52. These lines provide means for blowing out any accumulated moisture in the members.

FIG. 2 shows the undulatory movement of the liner obtained by inflation of alternate members while those adjacent are deflated and vice versa. A sinusoidal shape wave motion as shown is imparted to the liner. The shape of the wave may be varied by selection of various spacing and size of the members and relative rigidity of the liner.

FIG. 3 shows a sectional side view of one of the members which illustrates the lift and direction of forces imparted to the liner as inflation of the member starts at the top and continues downward. The particulates within the container hold liner 16 and collapsed member 22 against wall 10. On inflation, member 22 flexes the liner breaking the bond of adhered particulates and, by outward and downward movement, pushes them toward the outlet.

Figure 4:
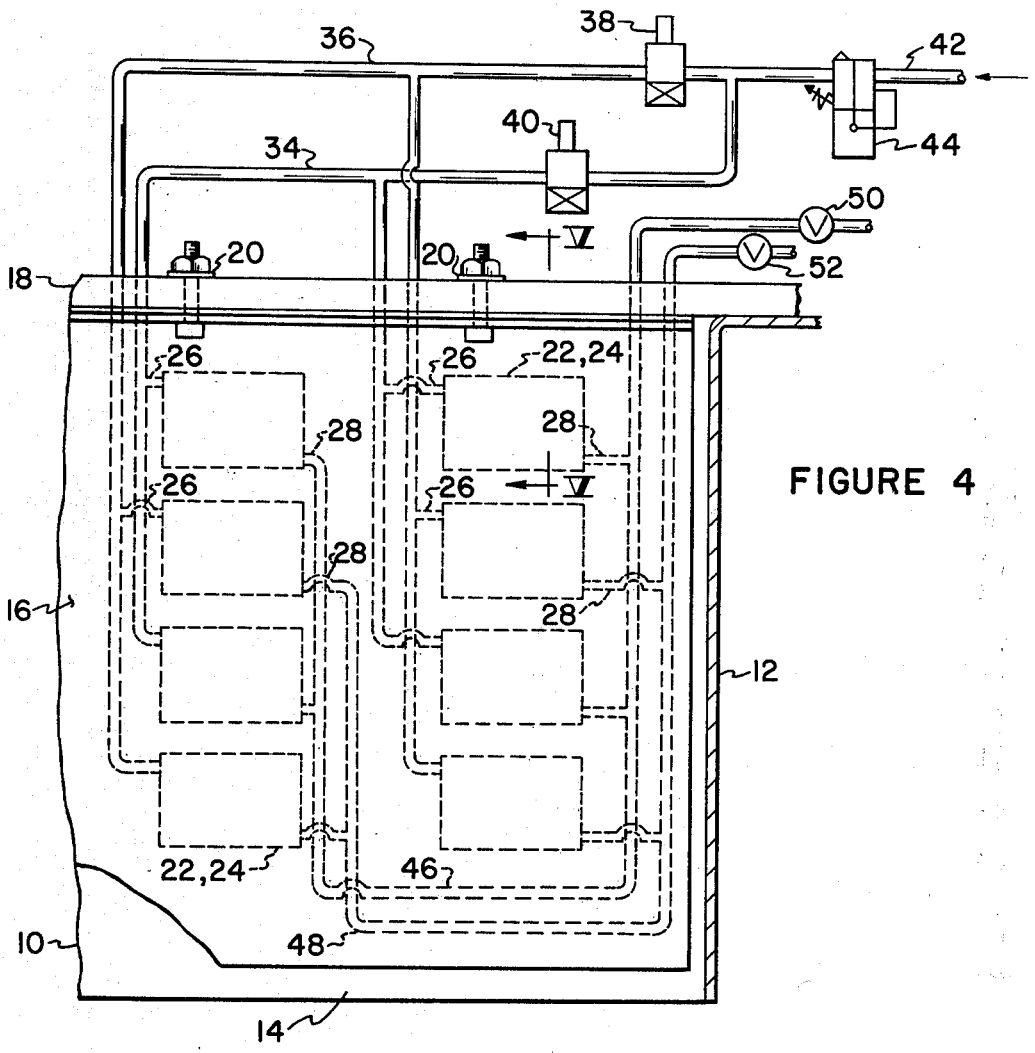
FIG. 4 is a schematic front elevation view of an alternative embodiment of apparatus for carrying out the method of this invention.
Figure 5:
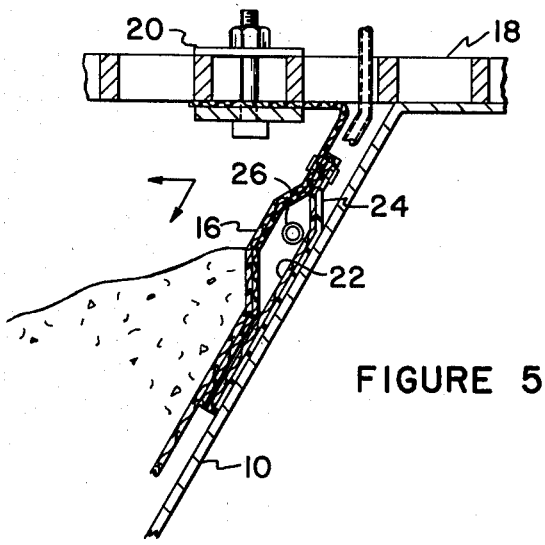
FIG. 5 is a side view taken at V—V of FIG. 4.

FIG. 4 illustrates square or rectangular shape members 22 which may be commercially available air bags. These members also are mounted in protective sacks 24. In this case the bags are held in position by attachment of the sacks 24 to liner 16. Again alternate of the members are connected to manifold 34, the others to manifold 36. In the piping arrangement shown, all the members in each horizontal row are inflated and deflated simultaneously. Solenoids 38, 40 are timed so as to inflate alternate rows while adjacent rows are deflated. FIG. 5 again illustrates creating of a wave in the liner as each member is inflated.

Various changes in the apparatus and arrangements thereof will be apparent to those skilled in the art without departing from the spirit and scope of the invention as defined in the following claims.

I claim:

1. A method of stimulating flow of particulates toward an outlet of a container and separating any weakly adherent particulates from an interior wall surface of said container, said method comprising:

providing a flexible wear resistant liner loosely covering said surface and a plurality of inflatable members spaced along the surface juxtaposed said surface and the liner, inflating and deflating said members so as to create alternate undulations from concave to convex curvature in the liner adjacent each of said members without stretching the material of said liner to a degree which would cause puncture thereof by said particulates, the relative rigidity of said liner together with the spacing and size of said members being such that undulatory movement in the liner adjacent each of the inflatable members overlaps that of the neighboring members nearest thereto in order to achieve separation of any weakly adherent particulates from the liner as well as to dislodge particulates in the container.

2. The method of claim 1 wherein the members provided are separate from said liner.

3. The method of claim 1 wherein said inflating step includes inflating alternate of said members while simultaneously deflating others interspersed therebetween and vice versa.

4. The method of claim 1 wherein said members are arranged in at least two generally horizontal rows at different elevations of said surface, each of said rows including at least two members, and wherein said inflating step includes inflating all of the members in alternate of the rows simultaneously while also simultaneously deflating all of the members in other of the rows, and vice versa, so as to push said particulates downward toward said outlet.

5. The method of claim 1 wherein said inflating and deflating step includes at least inflating said members by introduction of fluid at a portion thereof located at the highest elevation with respect to said outlet so that inflation of each members creates a wave in said member pushing the particulates downward toward the outlet.

6. The method of claim 5 wherein said members are elongated and extend axially in a direction generally toward said outlet.

7. The method of claims 1, 3, 5 or 6 in which said inflating and deflating step includes creating undulations in the liner substantially without stretching the material of said liner.

* * * * *